United States Patent [19]

Schwarz et al.

[11] Patent Number: 4,715,431

[45] Date of Patent: Dec. 29, 1987

[54] REBOILER-CONDENSER WITH BOILING AND CONDENSING SURFACES ENHANCED BY EXTRUSION

[75] Inventors: Alexander Schwarz, Allentown, Pa.; Charles E. Kalb, East Northport, N.Y.; Charles C. Goebel, Westfield, Pa.

[73] Assignee: Air Products and Chemicals, Inc., Allentown, Pa.

[21] Appl. No.: 872,310

[22] Filed: Jun. 9, 1986

[51] Int. Cl.[4] ..... F28F 3/04; F28F 3/12; F28D 9/02

[52] U.S. Cl. ..... 105/110; 165/133; 165/165; 165/179; 165/911; 165/913; 62/36; 62/42

[58] Field of Search ..... 165/111, 166, 110, 133, 165/165, 179, 911, 913; 62/285, 288, 36, 42

[56] References Cited

U.S. PATENT DOCUMENTS

| | | | |
|---|---|---|---|
| Re. 30,077 | 8/1979 | Kun et al. | 165/133 |
| 1,275,492 | 8/1918 | Sterzing | 165/166 |
| 2,804,285 | 8/1957 | Peterson | 165/166 |
| 3,204,693 | 7/1965 | Kuhn | 165/145 X |
| 3,359,616 | 12/1967 | Butt | 29/157.3 |
| 3,720,071 | 3/1973 | Nasser et al. | 62/42 |
| 4,060,125 | 11/1977 | Fujie et al. | 165/133 |
| 4,153,501 | 5/1979 | Fink et al. | 165/111 X |
| 4,216,819 | 9/1980 | Notaro | 165/1 |
| 4,216,826 | 8/1980 | Fujickake | 165/133 |
| 4,371,034 | 2/1983 | Yamada et al. | 165/100 |
| 4,401,155 | 8/1983 | Royal et al. | 165/166 |
| 4,653,572 | 3/1987 | Bennett et al. | 165/133 |

FOREIGN PATENT DOCUMENTS

| | | | |
|---|---|---|---|
| 700402 | 12/1940 | Fed. Rep. of Germany | 165/166 |
| 3011011 | 9/1980 | Fed. Rep. of Germany . | |
| 3521914 | 1/1986 | Fed. Rep. of Germany | 165/166 |
| 1375105 | 9/1964 | France | 165/111 |
| 0152397 | 11/1980 | Japan | 165/166 |
| 2093583A | 9/1982 | United Kingdom | 165/166 |
| 1035398 | 8/1983 | U.S.S.R. . | |

OTHER PUBLICATIONS

Panchal et al., "Analysis of Nusselt-Type Condensation on Vertical Fluted Surfaces," Numerical Heat Transfer 3, pp. 357–371 (1980).

Webb, R. L., "The Evolution of Enhanced Surface Geometrics for Nucleate Boiling," Heat Transfer Engineering 2, pp. 46–69 (1981).

Rohsenow, W. M. "Boiling" Handbook of Heat Transfer Fundamentals, pp. 12-1 to 12-9 (1973).

*Primary Examiner*—Albert W. Davis, Jr.
*Assistant Examiner*—John K. Ford
*Attorney, Agent, or Firm*—Willard Jones, II; James C. Simmons; William F. Marsh

[57] ABSTRACT

The invention relates to a heat exchanger for use as a reboiler-condenser which increases the efficiency of heat transfer between boiling and condensing fluids such as cryogens, e.g. oxygen and nitrogen in an air separation unit. The exchanger has enhanced boiling and condensing surfaces and slightly inclined condensing passages built up from individually extruded passageway elements.

10 Claims, 9 Drawing Figures

FIG. 4
PRIOR ART
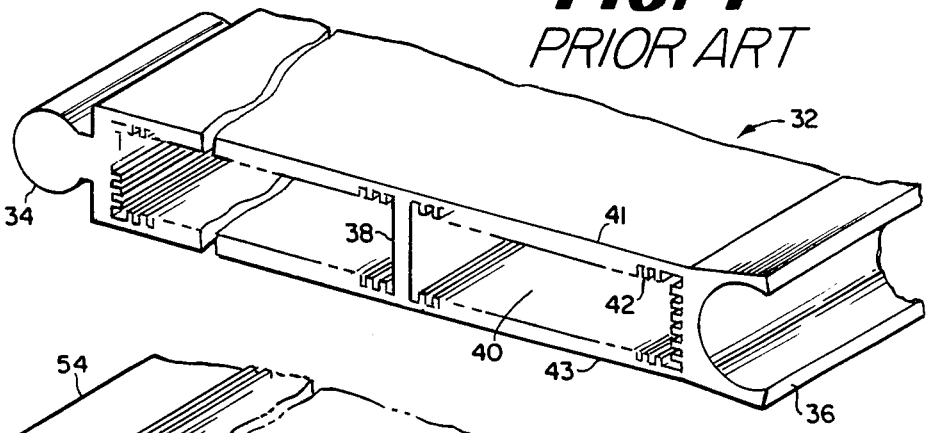
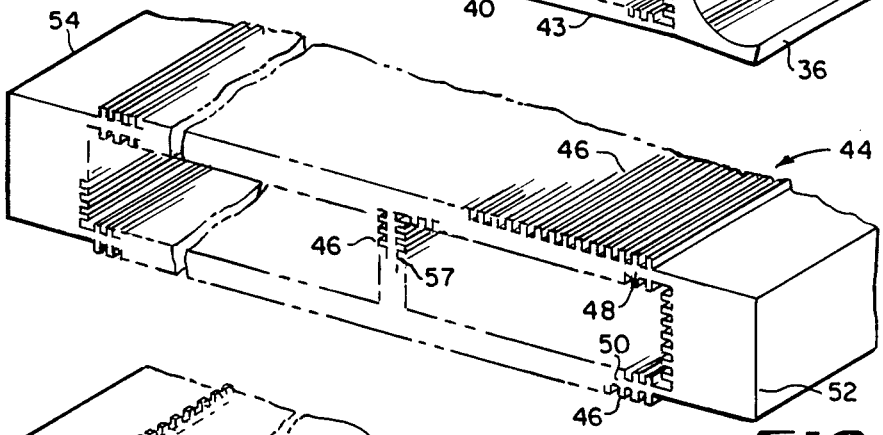
FIG. 5
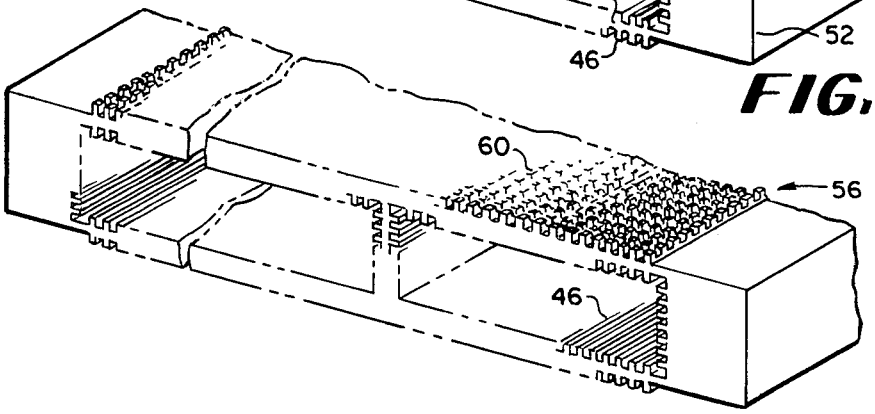
FIG. 6

REBOILER-CONDENSER WITH BOILING AND CONDENSING SURFACES ENHANCED BY EXTRUSION

TECHNICAL FIELD

This invention relates to equipment for boiling heat transfer in a reboiler-condenser in cryogenic and chemical applications.

BACKGROUND OF THE INVENTION

Two designs of heat exchanger are presently in general use for reboiler-condensers in cryogenic and chemical applications. The most common of these is the plate-fin brazed aluminum heat exchanger fabricated by disposing corrugated aluminum sheets between parting sheets to form a plurality of fluid passages.

The second type of heat exchanger in current use is a vertical shell and tube reboiler. To achieve a sufficiently low temperature difference with this design, enhanced surfaces are used. A porous boiling surface is applied to the inside of the tubes, and longitudinal flutes are used on the outside of the tubes. The disadvantages of the shell and tube design are the limited heat transfer surface which can be accommodated in a distillation column and the high cost of construction of the heat exchanger. In addition, this type of exchanger is subject to accumulation of thick liquid condensate films in the lower regions of the exchanger.

A third type of exchanger which is believed to have seen some application for reboiler-condensers in cryogenic separation plants and which is available commercially is the "BAVEX" type exchanger. This configuration is described in U.S. Pat. No. 3,720,071. Specially corrugated sheets are juxtaposed to define passages for the boiling oxygen and the condensing nitrogen. This exchanger is apparently also subject to the build-up of thick condensate films, since various attempts are described to put ribs, projections, and the like, on the condensing side of the corrugated sheets to remove the condensate from the sheets. The exchanger is intended to operate with boiling in the conventional manner from the plain metal surface of the corrugated sheets.

Russian Pat. No. 1,035,398 describes a plate type reboiler-condenser. The condensing passages have perforated corrugated inserts and inclined channels machined into the plates which are intended to drain condensate to the sides of the exchanger. The boiling passages have ribbed projections on the plates, additionally covered with a porous enhanced boiling surface.

U.S. Pat. No. 4,371,034 describes a plate type evaporator with an enhanced porous surface applied to the boiling side. The boiling liquid is recirculated in thermosyphon fashion. Since the heating medium can be a condensing stream, the proposed heat exchanger can be used as a reboiler-condenser. The heat exchanger is a combination of an enhanced boiling surface on the plates of a conventional exchanger of the plate type. The gasketed construction is unsuitable for cryogenic service. No enhancement is proposed for the hot, i.e. condensing, side of the exchanger.

West German Pat. No. 3,011,011 describes a plate type reboiler-condenser for air separation service, where individually extruded plates are stacked and brazed together to form vertical boiling and condensing channels with small rectangular cross sections. Voids in the extruded plates comprise the condensing channels, and longitudinal thick ribs on the plates comprise fins in the boiling passage. These fins are much thicker than those used in conventional plate-fin brazed aluminum exchangers. The boiling channels defined between the ribs of the extrusions do not communicate with one another and could pose a safety problem if even one of the small channels were to be inadvertently closed off and permit dry boiling to occur. Putting an enhanced boiling surface on the ribbed side of the plates is disclosed; however, no enhancement is provided on the condensing side.

SUMMARY OF THE INVENTION

The present invention is a heat exchanger for reboiler or condenser service which comprises a plurality of extruded enclosed passageways of a thermally conductive material having interior surfaces and exterior surfaces. These passageways have on all interior surfaces an enhanced condensing surface and on two opposing exterior surfaces an enhanced boiling surface. The passageways are assembled in a stack, with the exterior enhanced boiling surfaces of each pair of passageways facing the enhanced boiling surface of its neighbor. The stack of passageways is assembled so that the longitudinal axes of the passsageways are inclined from the horizontal, thereby defining downward sloping condensing channels, with interposing support bars between the exterior enhanced boiling surfaces of a pair of passageways. These support bars, between passageways with the enhanced boiling surfaces facing each other, being disposed vertically define vertical boiling channels. The support bars and passageways are joined together, typically by brazing; and means such as side bars are provided for closing vertical edges between alternating pairs of passageways wherein the enhanced boiling surfaces face each other.

BRIEF DESCRIPTION OF THE DRAWINGS

FIG. 4 is a schematic representation of an extruded condensing passage element.

FIG. 5 is a schematic representation of an extruded condensing passage element with an enhanced boiling surface on the exterior of the element.

FIG. 6 is a schematic representation of an extruded condensing passage element with a saw-tooth type boiling surface on the exterior of the element.

FIG. 9 is a cut-away perspective of the heat exchanger of the present invention as disposed in the sump of an air separation double column.

DETAILED DESCRIPTION OF INVENTION

In the operation of a cryogenic air separation plant of the generally used double column design, the power consumption of the air compressor is directly related to the temperature difference between the oxygen being reboiled in the low-pressure column and the nitrogen being condensed in the high-pressure column. Reduction of the temperature difference across this reboiler-condenser will permit reduction of the power consumption for the production of oxygen and nitrogen. Typically, a reduction of one degree Fahrenheit in the temperature difference will permit a reduction of about 2% in air compression power and a reduction of about 1% in the cost of producing oxygen gas. It is also important that the reboiler-condenser equipment should be compact and preferably able to fit entirely within the distillation column.

Thus the purpose of the present invention is to reduce both the power cost and capital cost associated with the air separation process. Similar benefits may be obtained in other processes where a reduction of heat transfer temperature difference in a compact device is of value. This applies especially in the cryogenic process industry; for example in the processing of natural gas, hydrogen, helium and other gases where the cleanliness of the system permits the use of compact heat exchange equipment.

Figure 1:
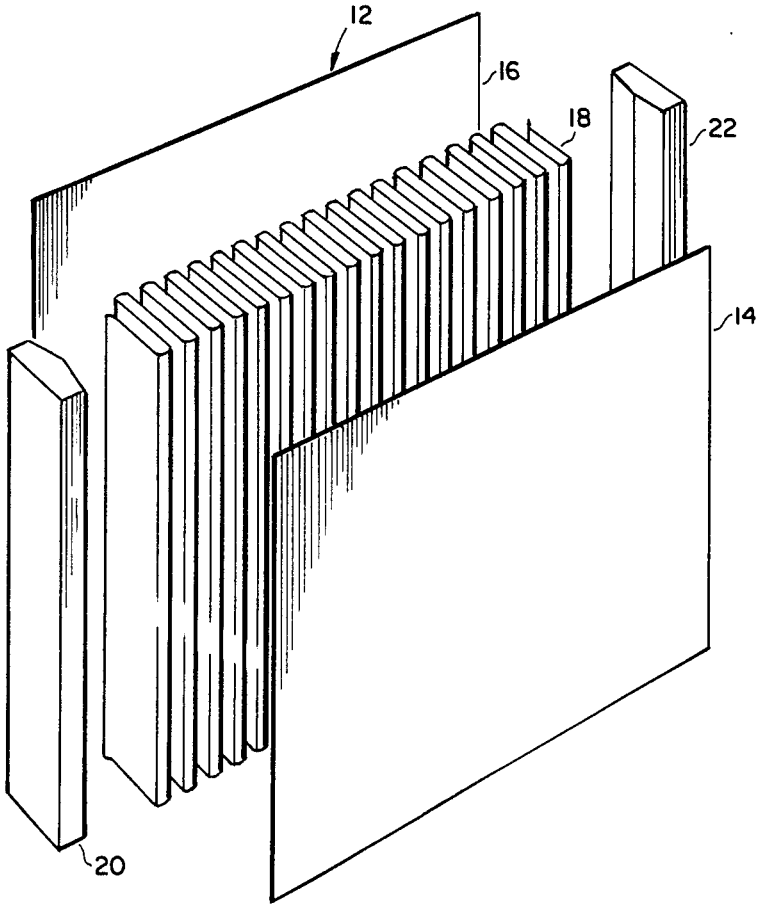
FIG. 1 PRIOR ART
FIG. 1 is an exploded perspective of a basic element of a conventional plate-fin brazed heat exchanger.
Figure 2:
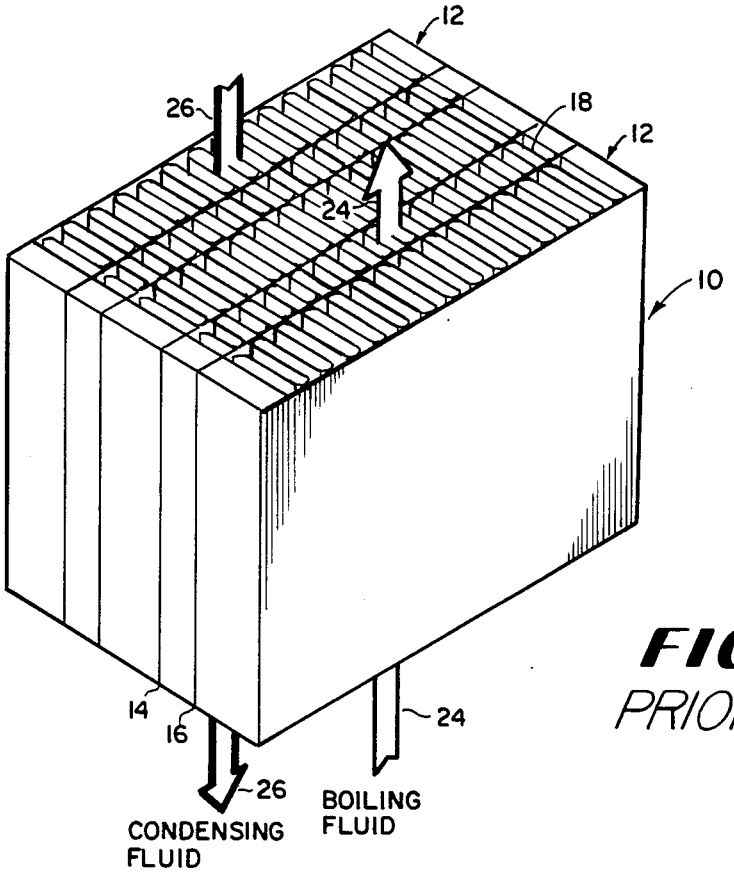
FIG. 2 PRIOR ART
FIG. 2 is a perspective detailing the flow passages in a conventional plate-fin heat exchanger.

A typical heat exchanger 10, of the plate-fin type, is shown in FIG. 2. Heat exchanger 10 consists of a plurality of sub-assemblies 12 (FIG. 1) comprised of aluminum parting sheets 14 and 16, normally 0.03 to 0.05 inches thick, which are disposed on either side of corrugated aluminum sheet 18 which serves to form a series of fins perpendicular to the parting sheets. Typically, the fin sheet 18 will have a thickness of 0.008 to 0.012 inches with 15 to 25 fins per inch and a fin height (distance between parting sheets) of 0.2 to 0.3 inches. Each sub-assembly 12 is formed by brazing together two parting sheets 14 and 16 spaced apart by a fin sheet 18 with the edges enclosed by side bars 20 and 22, as shown in FIG. 1. A complete heat exchanger 10 is assembled by brazing together a plurality of sub-assemblies 12 spaced apart by corrugated sheets such as 18.

Figure 3:
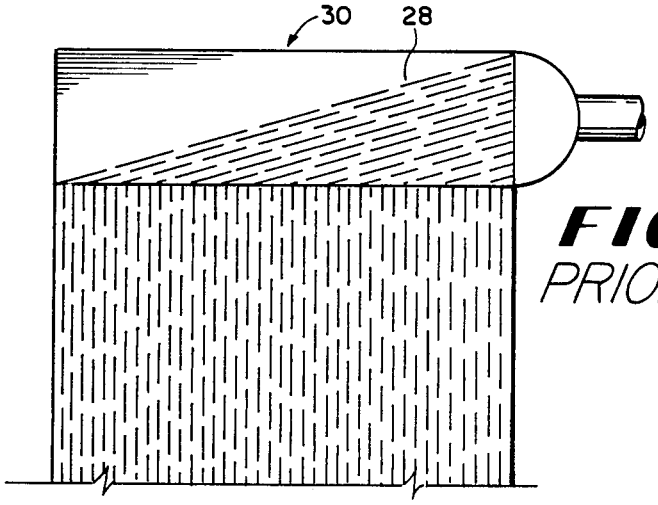
FIG. 3 PRIOR ART
FIG. 3 is a diagram detailing the side header and distributor fin for the condensing passages in a conventional plate-fin heat exchanger.

The exchanger 10 (FIG. 2) is immersed in a bath of the liquid to be boiled with the parting sheets, e.g., 14 and 16, and the fins, e.g 18, orientated vertically. Alternate passages separated by the parting sheets contain the boiling and condensing fluids. The liquid to be boiled enters the open bottom of the boiling passages and flows upward under thermosyphon action. as shown by arrow 24. The resulting heated mixture of liquid and vapor exits via the open top of the boiling passages. The vapor to be condensed is introduced at the top of the condensing passages through a manifold welded to the side of the heat exchanger and having openings into alternate passages. The resulting condensate leaves the lower end of the condensing passages through a similar side manifold, as shown by arrow 26. Special distributor fins 28, inclined at an angle to vertical in header 30, are used at the inlet and outlet of the condensing passages, as illustrated in FIG. 3. The upper and lower horizontal ends of the condensing passages are sealed with end bars (not shown), as is known in the prior art.

The present invention is a reboiler-condenser especially useful in increasing the efficiency of heat transfer between boiling and condensing fluids such as cryogens, e.g., oxygen and nitrogen. The heat exchanger of the present invention has enhanced boiling and condensing surfaces and condensing passages built up from individually extruded honeycomb elements. An example of such an element is shown as in FIG. 4. Element 32 is extruded from aluminum so that it has a plurality of internal channels 40, having finned surfaces, e.g 42, on two opposing sides of channels 40. The plurality of channels are separated by support members 38 and the opposite ends of element 32 have mating connectors 34 and 36 respectively. One type of connector can be a ball and socket as illustrated in FIG. 4, whereby the socket 36 is crimped closed after ball 34 of the adjoining element is inserted into socket 36.

The concept of an extruded honeycomb heat transfer element is known in the heat transfer art. An example is U.K. Pat. No. 2,090,651 where the exterior planar surface of a multi-void extrusion is dimpled inwardly to create turbulence and improve heat exchange in the fluid flowing through the interior channels. However, such devices have not been shown to be useful for a reboiler-condenser for cryogenic service.

The width of the extruded condensing passage elements is currently limited by the extrusion technology. This limit is approximately 6 inches. For the element 32 of FIG. 4, somewhat greater widths than about 3" could be extruded if the special mating crimp connectors 34 and 36 on the sides of element 32 were replaced by simple squared off sides, in which case the elements would be connected one to another by brazing. The length of the extruded passage elements has no practical limitations, and the elements would be cut to length to conform with a given exchanger design. The overall thickness of an extruded element is also limited by the extrusion technology, since there will be a minimum wall thickness required for structural integrity during the extrusion process. In addition, the wall thickness and the number and thickness of the support members 38 in the extrusion are chosen to withstand the design pressure of the condensing fluid and any mechanical or machining operations which might be performed to produce the enhanced boiling surface, if any. In general, thin extrusions are more desirable than thick ones so that the heat transfer surface per unit volume of the exchanger can be made large.

The internal channels 40 of element 32 contain longitudinal fins or flutes 42 which are formed as an integral part of the extrusion. Fins or flutes such as 42 are known to enhance condensation through the action of surface tension forces which thin the condensate films on and near the crests of the fins or flutes. This enhancement mechanism is disclosed, for example, in Panchal, C. B. and K. J. Bell, "Analysis of Nusselt-Type Condensation on a Vertical Fluted Surface," Numerical Heat Transfer 3. 357–371 (1980) and in other sources known in the heat transfer art.

The exterior top and bottom surfaces 41 and 43, respectively, of the extruded condensing passage elements are modified to produce an enhanced boiling surface. This is accomplished either by extruding longitudinal fins or ridges as an integral part of the exterior of the extrusion, with subsequent deformation or modification to form subsurface re-entrant cavities, or by subsequently adding in a separate step any of the enhanced boiling surfaces known in the art. Such enhanced boiling surfaces which can be added as a thin layer include sintered porous metal layers, flame sprayed or plasma sprayed surfaces, and others.

An example of a copdensing passage element with extruded longitudinal fins or flutes on both the interior and exterior surfaces is illustrated schematically as element 44 in FIG. 5. Fins or flutes 46 can also be extruded on the support members 57 between the top and bottom walls 48 and 50, respectively, of element 44 to further increase the condensing side heat transfer area. Flat surfaces 52 and 54 are left at the sides of each extrusion to accommodate brazing foil which can be used to braze the required number of condensing passage elements together.

The longitudinal fins or flutes 46 on the exterior surfaces of element 44, if used as shown, would not be particularly effective for boiling a liquid since they would likely transfer heat by a less efficient convective vaporization mechanism rather than by nucleate boiling. To be effective at promoting nucleate boiling, the exterior fins or flutes would have to be modified by a subsequent manufacturing step to form the subsurface re-entrant cavities (not shown) known to be needed in the nucleate boiling process.

There are three ways in which the exterior longitudinal fins or flutes could be subsequently modified to produce a surface which would be effective at promoting nucleate boiling:

First, the longitudinal fins or flutes can be bent to one side so that the crest of each fin or flute almost touches the side of an adjoining fin or flute. This technique, when practiced on externally finned tubing, is known to increase pool boiling heat transfer coefficients by as much as a factor of 10 compared with the unbent fins. The key to success of this method is to form longitudinal gaps between bent fins or flutes which are smaller than the interior width of the so formed subsurface grooves. Such re-entrant grooves provide stable sites for bubble nucleation, the vapor so formed leaving at various points along the narrow gap between adjoining fins or flutes.

Secondly, the exterior longitudinal fins or flutes 46 of element 44 can be machined with a cutting tool at approximately right angles to the fins or flutes to produce the saw-tooth type surface 60 illustrated schematically with element 56 of FIG. 6. If the saw-tooth projections are then bent or rolled over to one side so that they touch the adjoining projections, an enhanced boiling surface having openings to subsurface grooves is formed that is similar to that produced commercially by Hitachi on the outside of round tubes, sold under the brand name Thermoexcel E TM, as is disclosed in U.S. Pat. No. 4,060,125.

Figure 7:
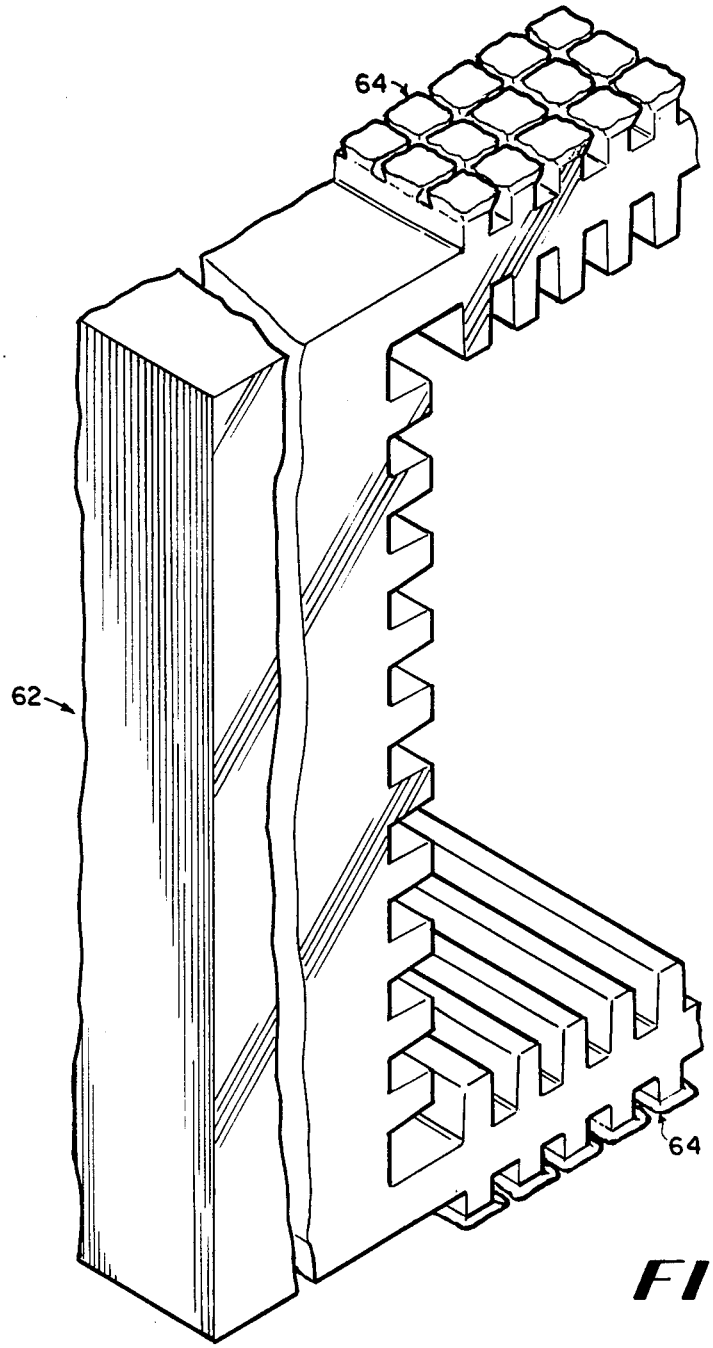
FIG. 7 is an enlarged schematic of the boiling surface of FIG. 6 formed by partially crushing the saw-tooth peaks.

Thirdly, if the saw-tooth type projections 60 as described above are partially crushed in a rolling operation instead of being bent to one side, the enhanced boiling surface 64 illustrated schematically with element 62 of FIG. 7 can be produced. Such a surface has a labyrinth of subsurface interconnected channels with re-entrant grooves opening into the boiling passage. Such surfaces greatly increase nucleate boiling compared with flat surfaces. The boiling surface 64 is a variation of one which has been patented for application to the outside of tubing, as is described in U.S. Pat. No. 4,216,826.

Figure 8:
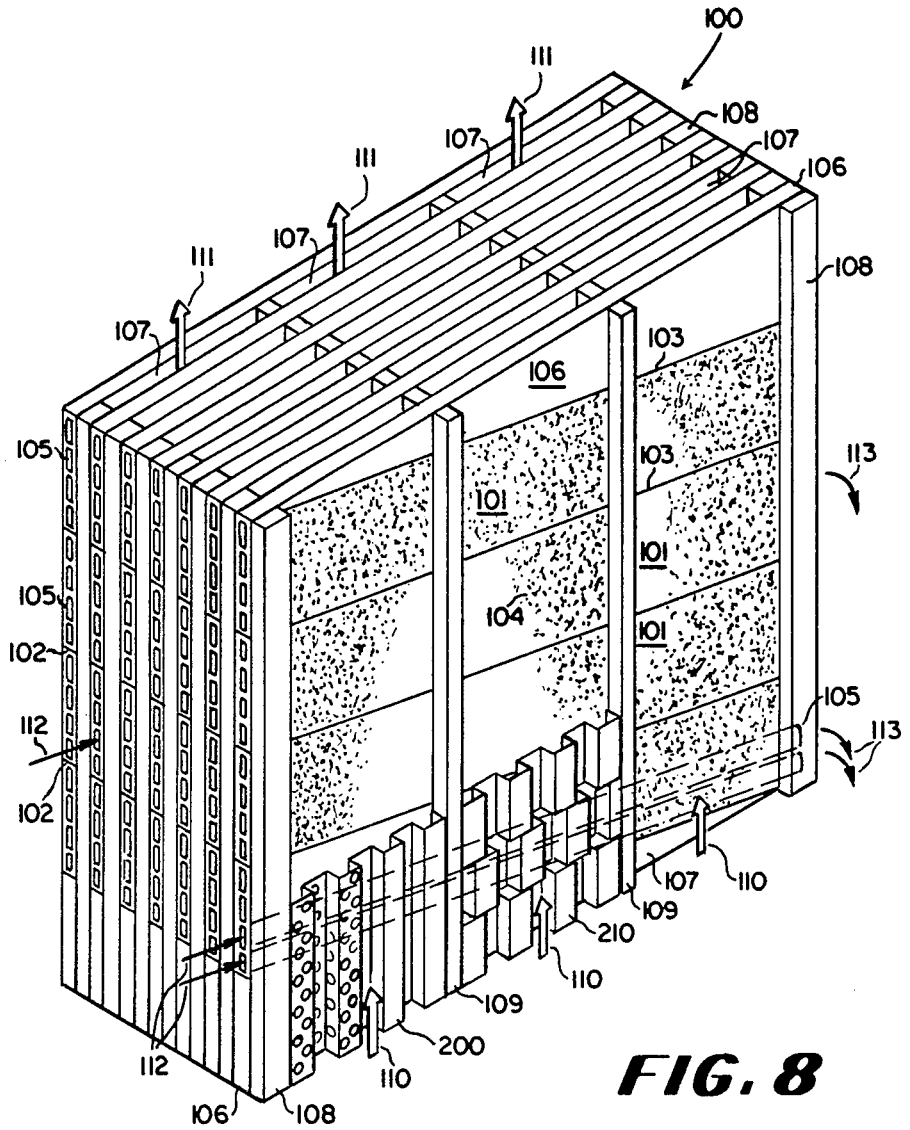
FIG. 8 is a partial perspective of the reboiler-condenser of the present invention.

FIG. 8 shows a method of assembly of an enhanced reboiler-condenser (exchanger) 100 clearly suited for use in an air separation plant. For purposes of illustration, seven boiling passages and eight condensing passages are shown. It should be made clear that the total number of alternating boiling and condensing passages and the overall dimensions of the exchanger will depend on the total heat exchange required in a given application, the dimensions of the individual extruded passage elements, the performance of the enhanced boiling and condensing surfaces for the fluids being used, and other engineering factors normally invoked during the design of reboiler-condensers. The reboiler-condenser 100 in FIG. 8 is shown with one of the end condensing passages removed so that the internal details of the boiling passages may be illustrated. Also, the header arrangements for the boiling and condensing streams have been omitted for clarity. Such details can vary from application to application and are not considered essential to the invention.

Each of the seven condensing passages, shown in FIG. 8, is built up from four individually extruded condensing passage elements 101. The total number of extruded passage elements 101 used in each condensing passage assembly will depend on the width of the individual extrusions, the maximum dimension of which is currently limited by extrusion technology. Generally it is desirable to make the individual extrusions as wide as possible to minimize the number of connections or braze points between the individual elements. With improvements in extrusion technology, it may be possible to extrude an entire condensing passage totally eliminating the need to connect individual elements.

The exchanger 100 is preferably constructed of aluminum and brazed as one completed assembly in a vacuum brazing furnace. The individual condensing passage elements 101 are connected by brazing along the party line or joint 102 on the faces of the exchanger where the condensing stream enters and leaves and along the party line or joint 103 in the interior of the exchanger 100. It should be pointed out that it is not essential to provide a completely leak-free joint along the party line or joint 103 in the interior of the exchanger 100, since all boiling passages at a given elevation in the exchanger are at the same pressure and contain the same fluid, however, joint 102 must be brazed to prevent leakage between the boiling and condensing fluids. In this regard, brazing along the party line or joint 103 could alternatively be omitted for the interior condensing passages. A gap between the extruded elements of the interior condensing passages could even be provided deliberately, if desired, in place of the party line or joint 103, to allow transverse flow between adjoining boiling passages and assure uniform flow distribution. Also, such communication between the boiling passages might be beneficial if conditions were encountered which would normally result in intermittent, plug-like flow of vapor in the boiling passages. In this instance, the presence of a finite gap or some other type of passage, gap or hole between the extruded condensing passage elements would help to laterally damp out pressure fluctuations within the exchanger and result in a more stable flow regime and operation. Such communicating passages could be easily provided by machining away a portion of the sides of the extrusions.

The two outermost condensing passage assemblies, each of which is constructed from a plurality of elements 101 have an enhanced boiling surface applied to only one side of the extruded elements, the side toward the interior of exchanger 100. All other condensing passage assemblies have an enhanced boiling surface 104 on both sides of the extruded elements 101. The condensing passage elements 101 containing multi-void chambers 105 therein are inclined downwards from the inlet side (left as shown in the drawing) of the condensing passages to the outlet side (right as shown in the drawing) to facilitate drainage of the condensate produced in these passages. The preferred angle of inclination of the extruded elements 101 from horizontal is in the range of 2 to 20 degrees. Solid triangular plates 106 are provided at the top and bottom of each condensing passage assembly to give a squared-off stacking configuration. These triangular plates probably do not contribute significantly to heat transfer between the boiling and condensing streams but may be desirable for structural integrity of the assembled exchanger. In some designs, the triangular plates 106 can possibly be omitted.

The reboiler-condenser 100 depicted in FIG. 8 implies that the number of condensing passages exceeds the number of boiling passages by one. An alternative exchanger configuration is achieved by closing off the two outermost boiling passages with flat end sheets. In this instance, the number of boiling passages exceeds the number of condensing passages by one, although boiling occurs on only one side of the two end passages.

Although not shown explicitly in FIG. 8 because of the scale of the drawing, the multi-void chambers 105 have integrally extruded longitudinal fins or flutes, similar to those shown in FIGS. 4 through 7, to enhance heat transfer on the condensation side of the exchanger.

The boiling passages 107 are open at the top and bottom of the exchanger, and the transverse space available for flow of the boiling fluid is determined by the thickness of side bars 108 and internal support bars 109 in the boiling passages. The support bars 109 are required during the brazing operation, since the exchanger would likely be positioned in the brazing oven with the condensing and boiling passages stacked horizontally. The support bars 109 possibly could be eliminated entirely giving completely open boiling passages, if the method of brazing heat exchangers with open passages disclosed in U.S. Pat. No. 3,359,616 is practiced. Alternatively, holes could be drilled through the support bars 109 to allow the boiling fluid to redistribute in a direction parallel with the condensing passages.

Liquid oxygen to be boiled enters the open boiling passages 107 at the bottom of the exchanger as represented by arrows 110. The boiling oxygen flows upwards under the action of thermosyphon forces, and a partially vaporized mixture leaves the open boiling passages 107 at the top of the exchanger, as represented by arrows 111. More liquid is circulated by the thermosyphon action than can be vaporized in one pass through the boiling passages. The vaporized oxygen disengages from the gas/liquid mixture 111 immediately above the exchanger, and the excess circulated liquid falls back into the pool of liquid oxygen in which the exchanger is immersed. For the particular application of boiling liquid oxygen in an air separation facility, it is particularly important, for safety considerations, to provide sufficient excess liquid oxygen circulation through the boiling passages. The excess liquid ensures that all surfaces in the boiling passages are wetted, thus avoiding dry boiling and the risk of solid hydrocarbon accumulation and explosion. Because the boiling passages of the present invention are free of the closely spaced fins used in conventional plate-fin brazed aluminum reboiler-condensers, the boiling-side fluid experiences less flow resistance. Therefore, under similar thermosyphon conditions, the present invention will result in substantially larger liquid circulation rates.

The gaseous nitrogen to be condensed enters the multi-void chambers 105 of condensing passage element 101 at the inlet side of the condensing passages (left-hand side of FIG. 8), as represented by arrows 112. The resulting nitrogen condensate leaves at the lower end of the multi-void chambers 105 (right-hand side of FIG. 8), as represented by arrows 113. Noncondensible gases, if present in the inlet gaseous nitrogen 112, will tend to accumulate at the discharge end of the condensing passages. Noncondensible gases are deleterious to the condensation heat transfer process if allowed to accumulate. These gases can be purged from the system through a vent valve (not shown) located exterior to the exchanger in the vapor space at the discharge of the condensing passages.

It should be emphasized that the slightly inclined (2 to 20 degree inclination) condensing passage elements 101 and the finned or fluted multi-void chambers 105 therein are one of the key aspects of the present invention. Condensation heat transfer within the multi-void chambers 105 is enhanced by two mechanisms not present in conventional plate-fin brazed aluminum reboiler-condensers. Firstly, the small fins or flutes on those portions of the multi-void chambers 105 which are not completely flooded by condensate will provide localized sites near the crests of these protuberances where the surface tension mechanism will significantly increase condensing heat transfer coefficients. Secondly, the slightly inclined and nearly horizontal orientation of the multi-void chambers, itself, will lead to significantly larger condensing heat transfer coefficients, as explained below..

Classical Nusselt theory for condensation of a vapor on a vertical surface predicts that the average heat transfer coefficient for a vertical surface is inversely proportional to the one-fourth power of the total height of the vertical surface. This decrease in the average heat transfer coefficient with increasing vertical height is a result of the increasing thickness of the condensate film as the film progressively moves down the vertical surface. Condensate forms because the latent heat of vaporization is removed from the vapor. Once formed, the condensate only presents an increasing resistance to further heat transfer. Conventional plate-fin brazed aluminum reboiler-condensers in air separation plants typically are approximately 100 inches high. This means that condensate formed at the entrance to the condensing passages at the top of a conventional plate-fin exchanger must travel downwards the entire vertical height of the exchanger about 100 inches, increasing the resistance to condensation heat transfer at all lower elevations in the exchanger. This is true of the condensate formed at all elevations in the exchanger, since all of the condensate exits at the bottom of the exchanger.

In contrast, the present invention provides for numerous points of condensate removal at the outlet end of every multi-void chamber 105. The vertical height of the multi-void chambers 105 in FIG. 8 typically would be on the order of about 0.5 inches. Condensate will form principally on the side walls of each multi-void chamber 105 and drain vertically downwards until it reaches the bottom portion of each chamber where it will join with other condensate formed in the higher inclined portion of that same chamber. All of the condensate formed in a given multi-void chamber 105 eventually exits as stream 113 at the outlet of the condensing passages. Because the condensate drains in the bottom of the multi-void chambers 105, most of the vertical side walls of these chambers will be available for condensing heat transfer. Although an exact analysis is not possible because of the complicated nature of the heat transfer and fluid flow processes, the classical Nusselt theory can be used to estimate the approximate advantage of the present invention over the condensation heat transfer in conventional plate-fin brazed aluminum reboiler-condensers. Since the effective vertical height for condensation in the present invention is typically about 0.5 inches rather than 100 inches in the conventional exchanger, the average condensing heat transfer coefficient in the present invention is expected to be larger by a factor of about $(100/0.5)^{\frac{1}{4}}$, or 3.8, than the average coefficient in the conventional exchanger. This is an increase of 280%.

Specific recommendations are not made here for various dimensions, parameters, etc., of enhanced boiling surfaces or the fins/flutes intended to enhance the condensation heat transfer process inside the multi-void chambers 105 of the extruded passage elements. It is known that such dimensions and parameters may have optimal values which depend on the physical properties of the fluids being used and, therefore, are application dependent. Criteria for designing enhanced boiling or condensing surfaces are available to one skilled in the art, once the application and fluids are chosen.

FIG. 9 shows how the proposed reboiler-condenser 132 could be mounted within the double column 130 of an air separation plant. The exchanger 132 is positioned in the sump of the low-pressure column and physically separates the high-pressure and low-pressure columns. Liquid oxygen shown by arrow 114 from the bottom tray of the low-pressure column falls into the sump. This liquid oxygen combines with liquid oxygen disengaging from the partially vaporized oxygen stream, arrow 111, at the top of the open boiling passages 107 and flows downwards through partitioned regions 115. Vertical parallel plates 116 divide the two oxygen-side segmental spaces between the exchanger and the walls of the low-pressure column into partitioned regions 115. Liquid oxygen stream, arrow 110, then enters the open boiling passages 107 at the bottom of the exchanger. If desired, a liquid oxygen product stream could be withdrawn through a pipe, not shown, and a gaseous oxygen product stream could be withdrawn from the vapor space above the exchanger.

The two nitrogen-side segmental spaces 118 between the exchanger and the walls of the high-pressure column are isolated from the low-pressure column by two segmental plates 119. Nitrogen vapor, arrow 112, rises from the top tray of the high-pressure column and enters the inlet side of the inclined condensing passage elements 101. Nitrogen condensate leaves at the lower end of the inclined passages, not shown. The collected nitrogen condensate leaves through a pipe, not shown, and is returned as reflux to the high-pressure column. If desired, a liquid nitrogen product can also be withdrawn through a pipe, not shown. If desired, a gaseous nitrogen product can be withdrawn through a pipe, not shown. Noncondensible components of the vapor, if present, can be withdrawn through a pipe, not shown.

It is known that a liquid to be boiled in thermosyphon fashion does not begin boiling immediately at the entrance to the boiling passages. This is because the liquid is somewhat subcooled at that point because of the imposed hydrostatic head of liquid in the sump. This means that there will be a region at the lower end of the boiling passages where heat is transferred only by convection. Therefore, a variation of the exchanger shown in FIG. 8 suggests itself, whereby conventional corrugated fin of the perforated or serrated type, shown as fins 200 and 210, respectively, in FIG. 8, is placed in the lower approximately 10 to 30% of the boiling passages to significantly speed up the rate of heating of the liquid so that this nonboiling region can be made as small as possible. In this case. the enhanced boiling surface could be omitted in this lower region of the boiling passages.

Although the present improved reboiler-condenser has been described in terms of thermosyphon boiling, the invention will provide the same advantages when the boiling-side fluid is circulated by forced flow rather than by thermosyphon action.

The proposed enhanced reboiler-condenser increases the efficiency of heat transfer between boiling and condensing fluids through several mechanisms. The improved efficiency results in a substantial reduction of temperature difference at a given heat flux. In the case of an air separation plant, the power and capital costs associated with the air compressor can be reduced. Improvements in compactness of the exchanger and oxygen safety are also obtained.

The distinguishing features of the invention are as follows:

The condensing channels, along with the fins or flutes which enhance condensation heat transfer, are produced in an integral extrusion. These passageways are sturdy and can easily withstand the higher pressure of the condensing nitrogen inside the channels. An enhanced boiling surface is formed on the exterior of the passageways, either by modifying integrally extruded exterior fins or ribs or by applying the surface in a separate step or steps. In either case, a sturdy, compact, doubly-enhanced passageway is formed, from which an entire reboiler-condenser can be built up by adding simple additional parts such as end and support bars and headers.

The condensing channels are inclined downwards slightly from horizontal (2 to 20 degrees). This permits withdrawal of condensate at many elevations in the exchanger, eliminating a serious shortcoming of the prior art heat exchangers. This enhancement alone could result in improvement of as much as about 280% in condensing heat transfer coefficients.

Both the condensing and boiling channels are free of the closely spaced fins used in conventional plate-fin reboiler-condensers. This leads to lower inherent pressure drop on both sides of the present exchanger. Besides being more efficient, energy wise, the lower frictional resistance in the boiling passages results in a larger circulation rate of excess liquid oxygen through the passages, giving an inherently safer exchanger.

Because the boiling passages are completely open, except as interrupted by any support bars which may be needed, the boiling fluid is free to redistribute within the boiling passages. This is a distinct advantage in preventing the possibility of dry boiling of oxygen. Moreover gaps can be purposely included between the extruded passage elements 101 of the interior passages. allowing the boiling passages to communicate transversely throughout the entire exchanger. This would provide a stabilizing effect on the boiling side flow regimes and contribute to providing a safe environment for the boiling of oxygen.

Disadvantages of the plate-fin brazed aluminum heat exchanger which are overcome by the present invention are:

(a) The two phase boiling stream cannot easily redistribute in a direction perpendicular to its flow.

(b) A very close fin spacing is required in both the boiling and condensing passages to obtain enough secondary heat transfer surface and still result in a heat exchanger volume which will fit within the distillation column. The closely spaced fins present considerable resistance to flow and may result in a relatively low liquid/vapor flow ratio at the outlet of the boiling passages and high pressure drop losses in the condensing passages. The higher pressure drop losses in the boiling passages result in an unfavorable change in the boiling vapor pressure equilibrium curve increasing the overall top-end temperature difference between the boiling and condensing fluids and, correspondingly, decreasing the efficiency of the reboiler-condenser.

(c) Liquid condensate films, which begin to form at the top of the condensing passages, must travel downwards over the entire height of the heat exchanger. Because the objective is generally to totally condense the warming stream (nitrogen in the case of an air separation plant), the condensate films get progressively thicker as they approach the lower end of the condensing passages, causing the condensation heat transfer process to be progressively hindered in the lower regions of the condensing passages. This in turn hinders the overall heat transfer process and contributes to a significant temperature difference between the condensing and boiling fluids necessary to transfer the desired amount of heat.

(d) The finned boiling passages are not amenable to incorporation of enhanced boiling surfaces. Boiling in the finned passages occurs through the process of convective vaporization at the surface of liquid films, since the temperature differentials between the plain metal parting sheets and fins and the boiling fluid are generally too small to support the more efficient nucleate boiling process which produces bubbles of vapor at the liquid/metal interface. In contrast, it is known that enhanced boiling surfaces, such as applied porous metal layers and machined or otherwise deformed metal surfaces which comprise subsurface re-entrant cavities and which are known in the art, are very effective at promoting the nucleate boiling heat transfer mechanism. It is especially significant that these enhanced boiling surfaces are effective even at very small temperature differentials between the surface and the boiling fluid, an attribute which makes them particularly attractive for reducing the power and capital costs associated with the air separation process.

Items (a) and (b) above are especially significant when considering operating safety in an air separation plant, where it is especially important to avoid dry boiling which could cause accumulation of solid hydrocarbons (present in minute amounts as impurities) and consequent risk of explosion.

The spirit of the invention does not preclude other methods of forming an enhanced boiling surface on the exterior of the extruded condensing passage elements.

In the foregoing description, reference is made to the use of the proposed enhanced reboiler-condenser in an air separation facility. Such reference is intended to point out one effective use for the invention; however, the present invention can be used in any process or apparatus employing boiling or condensing heat exchange.

The present invention has been described with reference to a preferred embodiment thereof. However, this embodiment should not be considered a limitation on the scope of the invention, which scope should be ascertained by the following claims.

We claim:

1. A heat exchanger for reboiler-condenser service which comprises: a plurality of extruded passageways of a thermally conductive material comprising one or more internal longitudinal channels, means for condensate film thinning on all surfaces of said internal longitudinal channels, and means for promoting boiling on only two opposing exterior surfaces of the extruded passageway assembled in individual stacks, with said exterior without the means for promoting boiling of each of passageways juxtaposed to that of its neighbor, a plurality of stacks assembled in side-by-side relationship with said enhanced exterior boiling surface of said stack facing the means for promoting boiling of its neighboring stack, the individual stack of passageways is so assembled so that the longitudinal axes of said passageways are inclined from the horizontal without being vertical, thereby defining downward sloping condensing channels, with interposing support bars interposed between the exterior means for promoting boiling of neighboring stack of passageways; said support bars facing each other being vertical thereby defining vertical boiling channels; means for joining said support bars and passageways; and means for closing vertical edges between alternating pairs of passageways wherein the means for promoting boiling face each other.

2. The heat exchanger of claim 1 wherein said means for joining support bars and passageways is a brazed joint.

3. The heat exchanger of claim 1 which further comprises a conventional corrugated fin sheet located in the lower 10 to 30% of the boiling channels.

4. The heat exchanger of claim 3 wherein said conventional corrugated fin sheet is of the perforated type.

5. The heat exchanger of claim 3 wherein said conventional corrugated fin sheet is of the serrated type.

6. The heat exchanger of of claim 1 wherein said downward sloping condensing channels are at an angle 2° to 20° from horizontal.

7. The heat exchanger of claim 1 wherein said means for promoting boiling is a sintered porous surface.

8. The heat exchanger of claim 1 wherein said means for promoting boiling is a plasma sprayed surface.

9. The heat exchanger of claim 1 wherein said means for promoting boiling is a partially crushed saw-tooth surface.

10. The heat exchanger of claim 1 wherein said extruded passageway have means between them to allow transverse communication of boiling fluid throughout the heat exchanger.

* * * * *